US007114308B2

(12) United States Patent
Cox

(10) Patent No.: US 7,114,308 B2
(45) Date of Patent: Oct. 3, 2006

(54) METHOD AND APPARATUS FOR WRAPPING A LOAD

(75) Inventor: Bruce Naylor Cox, Yinnar South (AU)

(73) Assignee: Safetech Pty. Ltd., (AU)

( * ) Notice: Subject to any disclaimer, the term of this patent is extended or adjusted under 35 U.S.C. 154(b) by 0 days.

(21) Appl. No.: 10/398,675

(22) PCT Filed: Oct. 9, 2001

(86) PCT No.: PCT/AU01/01263

§ 371 (c)(1),
(2), (4) Date: Jul. 15, 2003

(87) PCT Pub. No.: WO02/30751

PCT Pub. Date: Apr. 18, 2002

(65) Prior Publication Data

US 2004/0031238 A1 Feb. 19, 2004

(30) Foreign Application Priority Data

Oct. 9, 2000 (AU) ..... PR0637

(51) Int. Cl.
*B65B 11/04* (2006.01)
*B65B 57/00* (2006.01)

(52) U.S. Cl. ..... 53/399; 53/64; 53/441; 53/556; 53/587

(58) Field of Classification Search ..... 53/399, 53/441, 504, 556, 587, 588
See application file for complete search history.

(56) References Cited

U.S. PATENT DOCUMENTS 4,235,062 A 11/1980 Lancaster, III et al.
4,248,031 A 2/1981 Del Pozo, Jr.
4,255,918 A 3/1981 Lancaster et al.
4,845,920 A 7/1989 Lancaster
5,195,297 A 3/1993 Lancaster et al.
5,195,301 A * 3/1993 Martin-Cocher et al. ..... 53/441
5,314,557 A 5/1994 Schwartz et al.

(Continued)

FOREIGN PATENT DOCUMENTS

AU 77306/87 2/1988

(Continued)

*Primary Examiner*—John Sipos
(74) *Attorney, Agent, or Firm*—Andrus, Sceales, Starke & Sawall, LLP

(57) ABSTRACT

Apparatus (2) for wrapping a load (18) placed on a turntable (4) having a mast assembly (8), a carriage assembly (12) adapted for vertical slideable movement along said mast assembly (8) and dispensing means (13) for dispensing tape material (80). The tape material (80) is transferred from the dispensing means (13) in response to rotation of the turntable (4) such that the tape material (80) wraps around the load (18) in a predefined pattern. The carriage assembly (12) and turntable (4) are configured for automated movement in response to a computer program stored in memory means (306) to enable wrapping of the load (18) with the tape material (80) in the predefined pattern. The carriage assembly (12) is positioned along the mast assembly (8) under control of the computer program in accordance with a rotational position of the load (18) to locate the tape material (80) at locations on the load (18). A pretensioning apparatus is also disclosed for pretensioning the tape material (80). Also disclosed is apparatus including adjusting the rate at which tape material (80) is payed out depending on a portion of the load (18) to be wrapped by the tape material (80). Also disclosed is tension adjustment apparatus (100) for varying the tension applied to the tape material (80).

37 Claims, 13 Drawing Sheets

U.S. PATENT DOCUMENTS

| | | | | | |
|---|---|---|---|---|---|
| 5,365,723 | A | | 11/1994 | Ramos | |
| 5,447,009 | A | | 9/1995 | Oleksy et al. | |
| 5,450,711 | A | * | 9/1995 | Martin-Cocher | 53/556 |
| 5,463,842 | A | | 11/1995 | Lancaster | |
| 5,491,956 | A | | 2/1996 | Donnelly et al. | |
| 5,496,599 | A | | 3/1996 | Schwartz et al. | |
| 5,572,855 | A | | 11/1996 | Reigrut et al. | |
| 5,575,138 | A | | 11/1996 | Reigrut et al. | |
| 6,003,578 | A | | 12/1999 | Chang | |
| 6,119,971 | A | | 9/2000 | Jones | |
| 6,170,228 | B1 | | 1/2001 | Zeman, III | |
| 6,370,839 | B1 | | 4/2002 | Nakagawa et al. | 53/64 |

FOREIGN PATENT DOCUMENTS

| | | | |
|---|---|---|---|
| AU | 615778 | * | 6/1991 |
| CA | 2130494 | | 3/1995 |
| DE | 297 18 981 | | 2/1998 |
| EP | 0 463 259 | | 1/1992 |
| EP | 1 083 126 | | 3/2001 |
| GB | 2 069 967 | | 9/1981 |
| WO | 92/07761 | | 5/1992 |
| WO | 93/24373 | | 12/1993 |
| WO | 00/58155 | | 10/2000 |

* cited by examiner

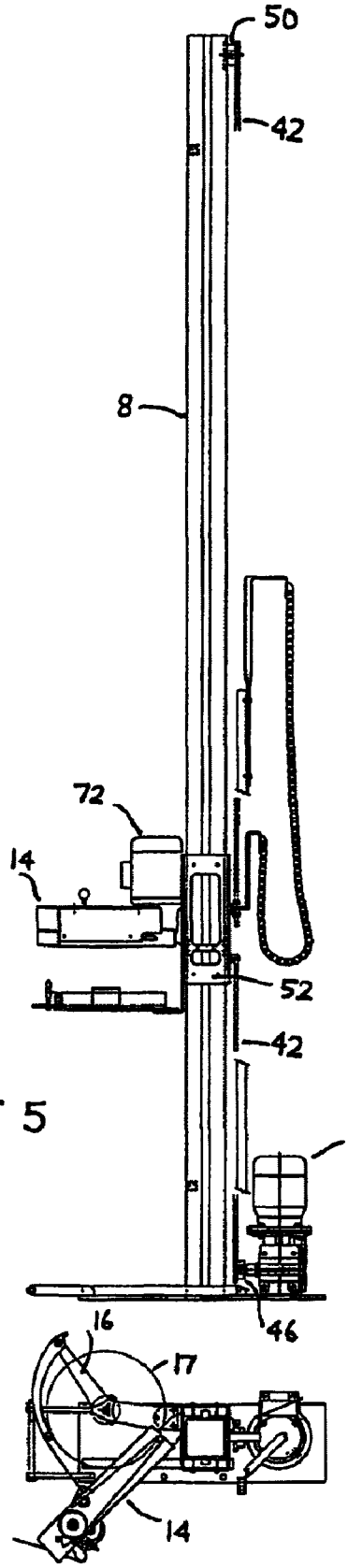
FIGURE 5
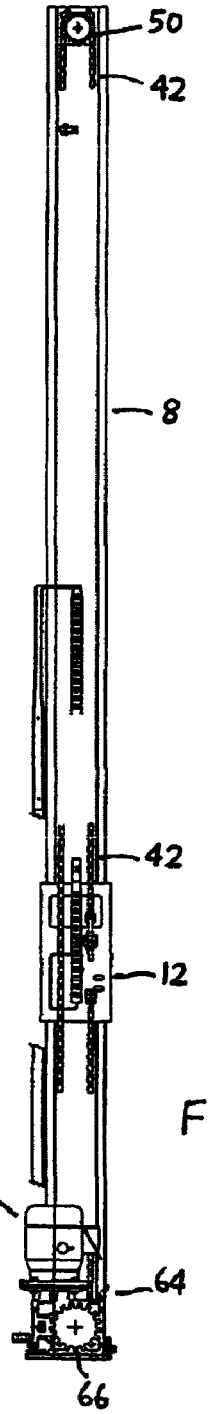
FIGURE 6
FIGURE 7

METHOD AND APPARATUS FOR WRAPPING A LOAD

CROSS REFERENCE TO RELATED APPLICATION

The present application is the U.S. national stage application of International Application PCT/AU01/01263, filed Oct. 9, 2001, which international application was published on Apr. 18, 2002 as International Publication WO 02/30751. The International Application claims priority of Australian Patent Application PR 0637, filed Oct. 9, 2000.

FIELD OF THE INVENTION

This invention relates to a method and apparatus for wrapping a load such as a palletised load with tape material and to apparatus for pre-tensioning stretchable material such as tape, prior to the material being applied to the load. This invention also relates to a method and apparatus for wrapping a load and controlling the rate at which tape is applied to the load depending on which part or portion of the load is being wrapped. The invention also relates to tension adjustment apparatus for varying the tension of tape material as it is applied to the load. A computer program means is also disclosed for executing the methods of wrapping a load

BACKGROUND OF THE INVENTION

Presently, there exists apparatus for wrapping a load, such as a number of layers of boxes that are stacked and supported on a pallet. The load is wrapped in film or tape to provide protection from the ingress of moisture to the load in the case of a film wrapping, and to provide support for and to secure the stacked boxes in situations where both film or tape is used. The load typically rotates on a turntable as tape or film is unravelled from a roll such that the tape or film wraps sequentially each side of the layers of boxes. The roll is supported on a mast for vertical movement to enable film or tape to be applied to the load in a predetermined pattern and to cater for varying heights of the load. There exists a need for a specific automated process to wrap a load such that the vertical movement of the roll of film or tape and the rotation of the turntable is controlled according to a control program, for example a computer program. Such an automated process is more efficient in that it saves time, uses less film or tape in that the load is rapped or secured in a predefined pattern.

There is also a need to provide a means for controlling the rate at which tape is applied to the load depending on which portion of the load is being wrapped. There is also a need to provide a requisite amount of tension in the tape as it is applied to the load so that as the load is rotating there is substantially no slack or too much tension in the actual tape being applied to the load.

Furthermore, the present invention provides a pre-tensioning apparatus for tensioning a stretchable material, such as tape, prior to the tape being applied to a load to be wrapped. The tape is required to be stretched or pre-tensioned to a length representing a multiple of its unstretched length so that when the tape is wrapped around the load it will partially shrink or reduce in length so as to wrap tightly and securely around a load. This process also reduces the length and volume of tape required. By using the present invention, loads to be wrapped may be done so by choosing a particular pattern of wrapping that secures the load with minimum usage of tape material. This has the benefit in reducing the amount of wasted tape or film material and thereby reduces costs associated with disposal of the unused or wasted material.

Present systems rely on a gearing mechanism whereby one gear is brought into engagement with another gear, having a different number of teeth, to pre-stretch the tape. A problem with such systems is that when the teeth of the different gears engage, they are wedged in tightly against each other. Consequently, the gears can bind and therefore require more force to feed the tape between rollers connected to the meshed gears providing the requisite tension to the tape. In some instances, the greater force required breaks the tape which is an obvious disadvantage. The present invention provides a unique way of pre-stretching the tape that eliminates binding of the meshed gearing arrangement and a facility for feeding tape through the assembly either under tension or not under tension for reasons that will become apparent from further reading of this specification.

Another problem identified in prior art systems in applying adhesive tape in a stretched condition to a load is that when the tape initially has to be placed on the load in an unstretched condition, the tape adhered to the surface of rollers of a pre-stretching apparatus which stopped a suer guiding the tape through the rollers in order to adhere the tape to a side of the load. This was due to the rollers being made from rubber compounds which provided too much friction for unstretched adhesive tape resulting in a build-up of deposited adhesive. With the tape caught or stuck on the rollers, the tape was difficult to peel off the rollers and eventually this led to the rubber compounds of the rollers wearing out. The rollers subsequently had to be replaced often. Aluminium rollers have been used but proved ineffective. The present invention seeks to address these problems by providing rollers in a pre-tensioning apparatus that enables tape to traverse through the rollers in both stretched and unstretched conditions.

SUMMARY OF THE INVENTION

According to a first aspect of the invention there is provided apparatus for wrapping a load placed on a turntable, said apparatus comprising:

a mast assembly;

a carriage assembly adapted for vertical slidable movement on said mast assembly;

dispensing means for dispensing tape material wherein said tape material is transferred from said dispensing means in response to rotation of said turntable such that said tape material wraps around said load in a predefined pattern;

said carriage assembly and said turntable being configured for automated movement in response to a computer program means so as to enable wrapping of said load in said predefined pattern; and wherein said carriage assembly is positioned along said mast assembly under control of said computer program means in accordance with a rotational position of said load in order to locate said tape material at locations on said load.

The turntable may be configured for rotational movement via a first drive means, said drive means driving a first sprocket means which imparts rotational movement to said turntable through a first drive chain. The carriage assembly may be linked to a second drive chain driven by a second sprocket means which in turn is driven by a second drive means to enable vertical movement of the carriage assembly.

Each of the first drive means and second drive means may be controlled by processor means, in accordance with said computer program means, to control the movement of said carriage assembly and said turntable so that the tape material dispensed from said dispensing means wraps around said load in said predefined pattern.

The apparatus may further comprise first sensor means and second sensor means to sense teeth of a toothed wheel, which may be either said first sprocket means or said second sprocket means. Alternatively, the links in said second drive chain and/or said first drive chain may be sensed. Each of the sensor means may transmit signals to said processing means in response to said sensing of said teeth and/or said links.

According to a second aspect of the invention there is provided a method of wrapping a load placed on a turntable, said method comprising the steps of:

rotating said turntable automatically in response to a computer program means;

providing a carriage assembly for slidable vertical movement along a mast assembly;

said movement of said carriage assembly being automated in response to said computer program means;

dispensing tape material from dispensing means whereby said tape material wraps around said load in a predefined pattern as said turntable rotates;

wherein the position of said carriage assembly on said mast assembly is in accordance with a rotational position of said load so as to locate said tape material at locations on said load.

The method may include the further step of sensing the position of the turntable and the position of the carriage assembly and transmitting signals representative of sensed positions of said turntable and carriage assembly to a processing means. In response to receiving the signals, the processing means may control the rotation of the turntable and the vertical movement of the carriage assembly in accordance with said program means.

According to a third aspect of the invention there is provided a pre-tensioning apparatus adapted for pre-tensioning tape material, said apparatus comprising:

first roller means having a first-gear means attached thereto; and second roller means having second gear means attached thereto and configured to move from a first position such that said tape material is in an unstretched condition to a second position such that said tape material is in a stretched condition, said second roller means carrying out said movement from said first position to said second position by pivoting about said first roller means and contacting said tape material, said tape material being fed between each of said first and second roller means.

Each of the first roller means and second roller means may be cantilevered in the sense that they are mounted from one end thereof.

The first gear means and second gear means may be arranged to constantly engage or mesh with one another to enable the pivoting motion of the second roller means about the first roller means and to provide a differential roller speed between each of said roller means to enable the stretching of the tape material.

According to a fourth aspect of the invention there is provided a pre-tensioning apparatus for pre-tensing tape material, said pre-tensioning apparatus comprising:

first roller means having a first gear means attached thereto; and second roller means having a second gear means attached thereto, said second roller means having slits in an exterior surface contactable with said tape material such that said slits in said exterior surface provide sufficient friction against said tape material when said tape material is in a stretched condition and minimal friction against said tape material when said tape material is an unstretched condition.

The second roller means may be configured for movement from a first position such that said tape material is in said unstretched condition to a second position such that said tape material is in said stretched condition. The second roller means may undertake movement from said first position to said second position, and vice-versa, by pivoting about the first roller means.

The tape may have adhesive material bonded to one side thereof. The side of the tape having adhesive material bonded thereto may contact said second roller means in said stretched condition. The tape may have a side free of adhesive material which may contact said first roller means.

According to a fifth aspect of the invention there is provided a method of automatically wrapping a load, said load being placed on a rotatable turntable, said method comprising the following steps:

rotating said turntable automatically in response to a computer program means;

dispensing tape material from a tape tensioning apparatus and subsequently wrapping the dispensed tape material around said load, said tape material being dispensed at a rate according to a portion of the load being wrapped;

wherein said tape tensioning apparatus dispenses said tape material at said rate in response to a signal received from a variable speed drive means and from a sensor means.

The tape material may be dispensed at an increased rate as the tape material approaches and contacts an edge portion of said load and at a decreased rate when the tape material has passed said edge portion.

According to a sixth aspect of the invention there is provided apparatus for automatically wrapping a load placed on a rotatable turntable, said apparatus comprising:

means for supplying tape material to wrap said load at a rate according to a portion of said load being wrapped;

variable speed drive means for controlling said means for supplying and thereby controlling said rate; and sensor means for detecting the rate at which said tape material is being applied to said load and transmitting a first signal to said variable speed drive means which in turn transmits a second signal to enable said supplying means to control said rate.

According to a seventh aspect of the invention there is provided a tension adjustment apparatus for varying the tension applied to tape material, said tape material being applied to a load placed on a rotatable turntable, said apparatus comprising:

adjustment means adapted for movement within a slot means, said slot means being defined within a bracket;

resilient means linked at one end to said bracket;

roller means from which said tape material is dispensed to wrap said load, said roller means also linked to said bracket;

wherein the position of said adjustment means within said slot defines a moment, based on the force in the resilient means, on which said roller means acts and thereby provides a tension on said tape material depending on said position of said adjustment means in said slot means.

According to an eighth aspect of the invention there is provided computer program means for executing a procedure to wrap a load in tape material on a turntable by:

controlling the rotation of said turntable;

controlling the movement of a carriage assembly along a mast assembly;

whereby said tape material is dispensed from dispensing means to be wrapped around said load in a predefined pattern as said turntable rotates; and wherein the position of said carriage assembly on said mast assembly is in accordance with a rotational position of said load on said turntable so as to locate said tape material at locations on said load.

According to a ninth aspect of the invention there is provided a computer readable memory, encoded with data representing a computer program for directing a processing means to execute a procedure for wrapping a load in tape material where said load is placed on a turntable, said processing means being directed to:

control the rotation of said turntable in response to said computer program;

controlling the movement of a carriage assembly along a mast assembly also in response to said computer program;

wherein tape material is dispensed from dispensing means to wrap around said load in a pre-defined pattern as said turntable rotates; and wherein the position of said carriage assembly on said mast assembly is in accordance with a rotational position of said load on said turntable in accordance with the computer program so as to locate said tape material at locations on said load.

BRIEF DESCRIPTION OF THE DRAWINGS

The invention will now be described in preferred embodiments with reference to the drawings wherein:

FIG. 5 is a side view of a mast assembly together with a carriage assembly and tape dispenser;

FIG. 6 is an end view of the apparatus shown in FIG. 5;

FIG. 7 is a plan view of the apparatus shown in FIG. 5;

DETAILED DESCRIPTION OF PREFERRED EMBODIMENT

Figure 1:
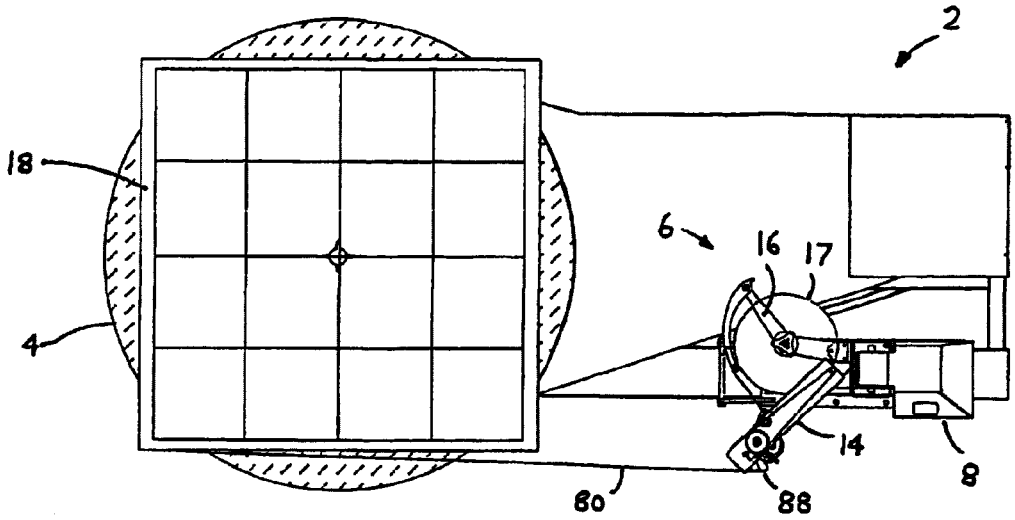
FIG. 1 is a plan view of apparatus for wrapping a load placed on a turntable according to a first embodiment.

Referring to FIGS. 1 to 4, there is shown apparatus 2 for palletising and wrapping a load 18. The apparatus 2 comprises a turntable 4 and stretch wrapping apparatus generally designated as numeral 6. The stretch wrapping apparatus 6 includes a mast 8 extending upwardly from and connected to a base plate 10, a carriage assembly 12 supported on the mast 8 for vertical reciprocating motion with respect to the mast 8. The carriage assembly 12 includes an arm assembly 14 and a mounting means 16 which supports a roll 17 of stretchable material, such as tape 80 to be dispensed therefrom and wrapped around a load 18 located on turntable 4. Dispensing means 13 may include the roll 17 and mounting means 16. Both the arm assembly 14 and mounting means 16 may be integrally formed with the carriage assembly 12 or connected directly to the carriage assembly 12. The carriage assembly 12 additionally has connected thereto a pre-tensioning assembly 20 through which the tape is pre-tensioned and dispensed therefrom to the load 18. A sensor 60 is mounted adjacent a toothed wheel 62 to sense the number of teeth of the toothed wheel passing to provide an indication of the number of revolutions of the turntable 4.

The tape 80 is preferably #8884 or #8886 manufactured by Minnesota Mining and Manufacturing (3M) or tape as disclosed in U.S. Pat. No. 5,496,599 to 3M.

The turntable 4 is constructed substantially in accordance with the disclosure in Australian Patent No. 615,778, to the present applicant, which is incorporated herein by reference. The turntable 4 is configured for rotational movement about a central hub 24. The turntable has a top plate and a bottom plate and located between the top plate and the bottom plate is a circular sprocket 26 which has teeth adapted to engage an endless drive chain 28 which passes around the sprocket 26 and also which drive chain 28 passes around drive sprocket 30 which is in turn powered and rotated by a power mechanism 32, in the form of an electric motor. The chain 28 passes around the drive sprocket 30 and imparts the rotational movement to the turntable through sprocket 26.

Referring to FIGS. 5 to 10, the vertical reciprocating movement of the carriage assembly 12 is enabled through a sprocket and pulley means existing at opposite ends of mast 8 wherein a drive chain 42 is attached to a part of the carriage assembly 12. A power mechanism in the form of an electric motor 44 drives a drive sprocket 46 located at the lower end of the mast 8 through drive shaft 48 to which the sprocket 46 is attached at the outer end thereof. At the upper end of the mast 8 there is a pulley 50 mounted at that upper end of the mast 8. The pulley 50 may be replaced by a sprocket which has teeth to engage the chain 42. The mast 8 is preferably hollow and cylindrical in shape such that the drive chain 42 driven by motor 44 passes along the outside of the mast 8, loops over each of the sprocket 46 and pulley 50 and passes down the inside of the hollow cylindrical mast 8. Any other suitable location of the chain 42 in relation to the mast assembly 8 may be possible. The carriage assembly 12 has a carriage tube 52 adapted to fit around the periphery of the mast 8 for slidable movement there along. The movement along the mast 8 is enabled through connections of the drive chain 42 to the carriage tube 52 by way of suitable connections such as depending lugs or flanges 54 and 56 located on the outer surface of the carriage tube 52. The mast assembly 8 may be constructed from aluminium or steel.

The movement of the carriage assembly 12 vertically up and down the mast 8 enables the tape 80 to be wrapped around a pallet load 18 in a helical or circular (banding) fashion whilst the turntable is rotating with the load 18. Particular patterns of the helical/circular wrapping or looping (which may be stepped helical) is enabled through the control of motors 32 and 44 to be described hereinafter.

It is to be noted that the speed of the motors 32 and 44 may be variable to impart varying speed to the turntable 4 and to the carriage assembly 12 on the mast 8.

Figure 2:
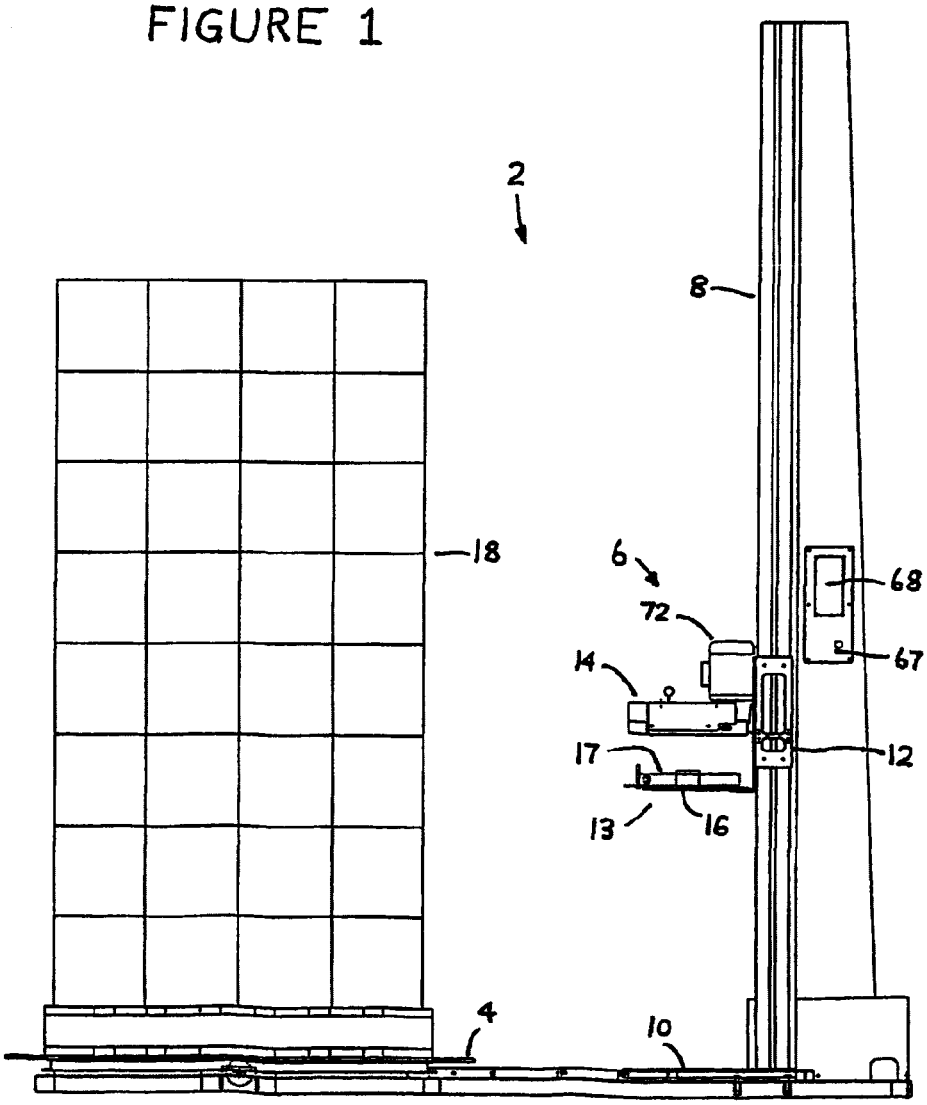
FIG. 2 is a side view of the load wrapping apparatus shown in FIG. 1.
Figure 3:
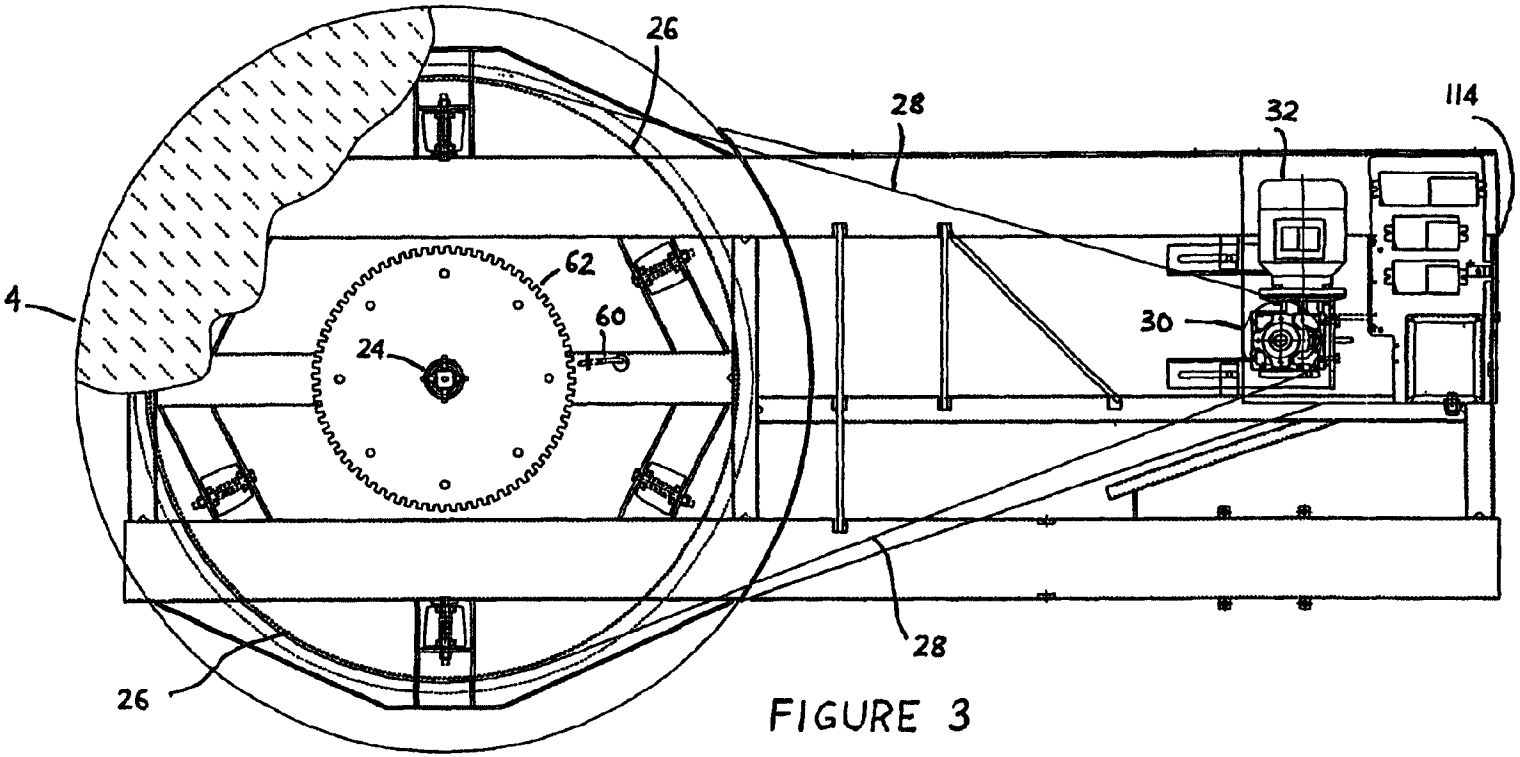
FIG. 3 is a detailed sectional plan view showing the various components of the turntable and a drive means for driving the turntable.
Figure 4:
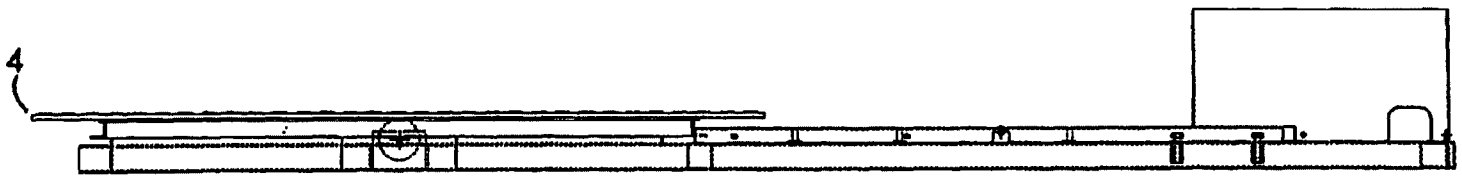
FIG. 4 is a side sectional view of the turntable shown in FIG. 3.
Figure 8:
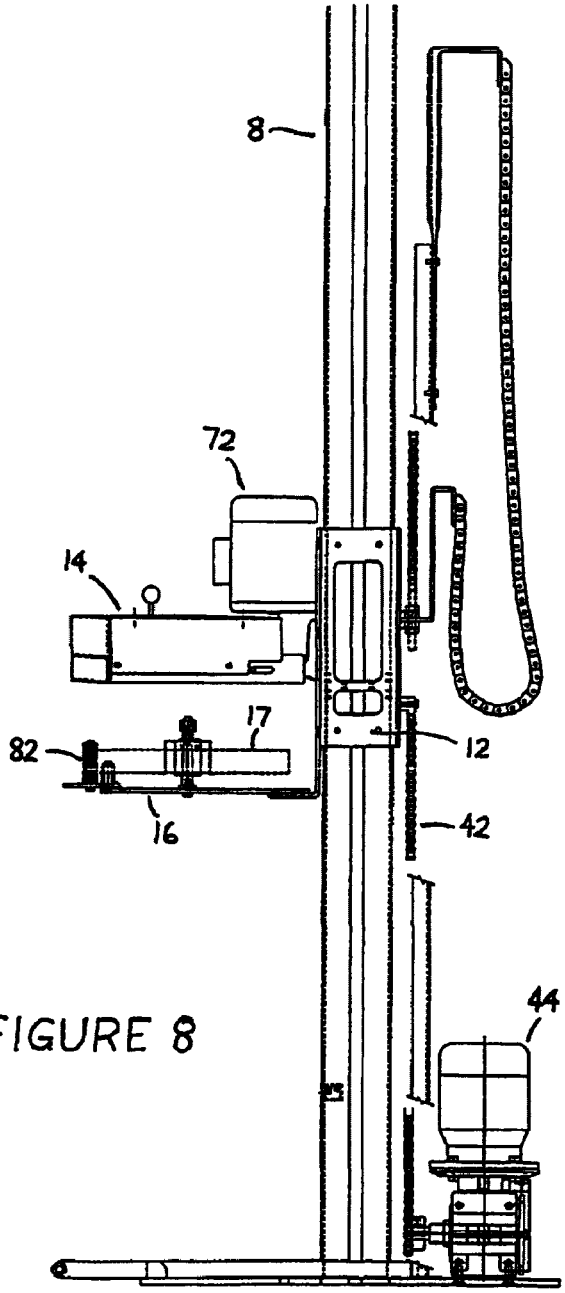
FIGS. 8, 9 and 10 are enlarged views of FIGS. 5, 6 and 7 respectively.
Figure 9:
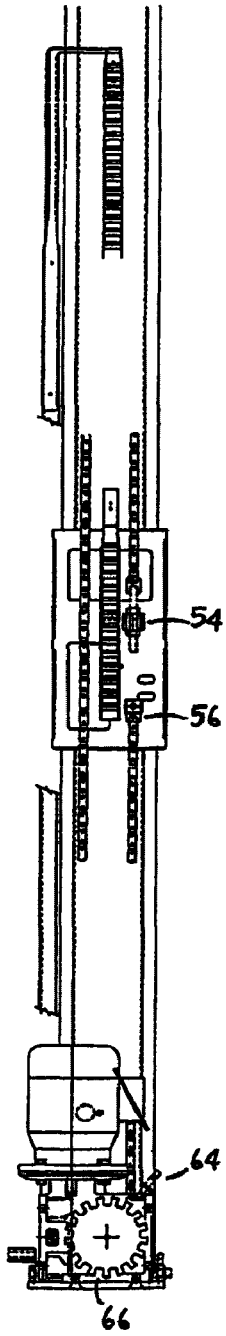
Figure 10:
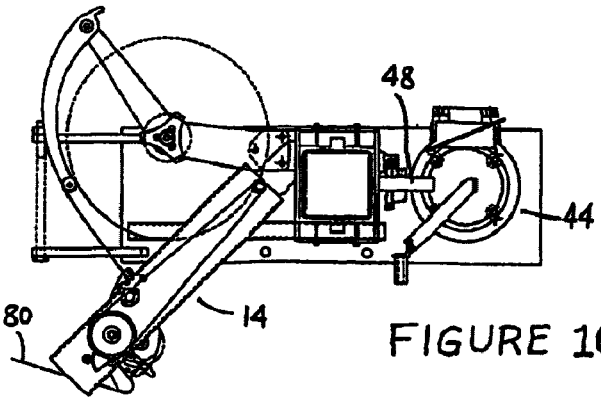

Connected to the mast assembly is a control panel structure 67 for attachment of an electronic circuit board and display means 68 (see FIG. 2). Electrical cables run to and from the circuit board 68 and from sensors 60, located near toothed wheel 62, and 64 located near toothed wheel 66. The sensor 64 is mounted adjacent the toothed wheel 66 to sense the number of teeth passing on toothed wheel 66 to indicate the displacement of the carriage assembly 12 along mast 8, to be explained hereinafter.

Figure 11:
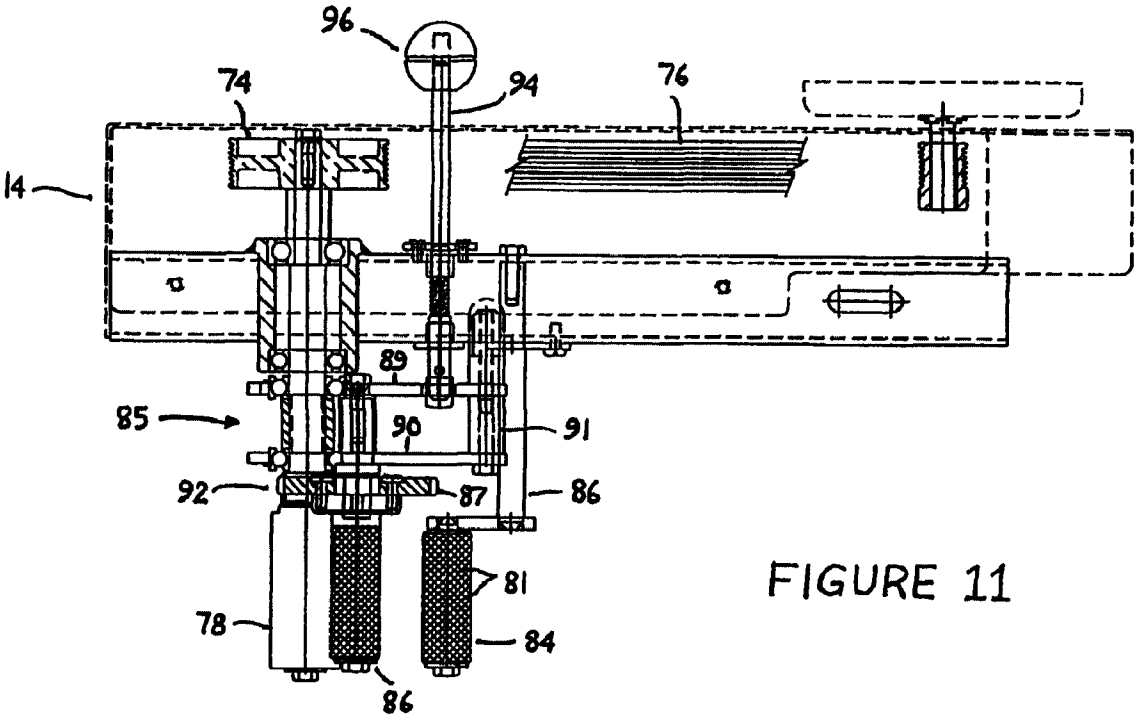
FIG. 11 is a side view of pre-tensioning apparatus shown in a closed condition.
Figure 12:
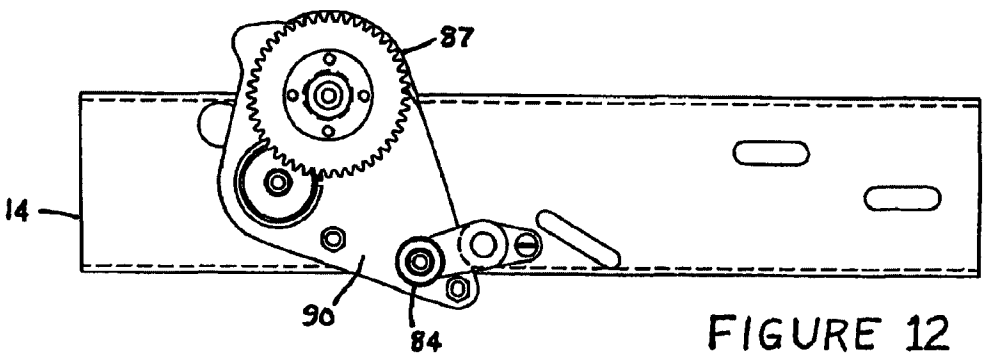
FIG. 12 is a view from underneath the pre-tensioning apparatus of FIG. 11.

Shown in FIGS. 11 and 12 is an embodiment of a pre-tensioning apparatus 70 extending form arm assembly 14 and which is driven by a motor 72 whereby the motor drives a spindle 74 via a belt 76 which in turn drives a supplying means in the form of a first roller 78 located or attached to the bottom of the spindle 74. Tape 80 is payed out from a roll of tape 17 which has a central portion 81 which locates the roll 17 and abuts mounting means 16 for supporting the roll 17 of tape 80. The tape 80 is initially fed around roller 82, which roller 82 abuts the circumference of the roll 17 of tape 80 and makes for a smoother release of the tape 80 from the roll 17, and thereafter the tape 80 is fed around the right-hand side of roller 84. Thereafter the tape 80 is guided through so that it is between second roller 86 (abutting the front surface) and the first roller 78 (abutting the rear surface) and thereafter it is guided around roller 88 (see FIG. 14) and then attached to the load 18. Roller 84 is connected to arm assembly 14 through a shaft and bracket arrangement 86. Second roller 86 is connected at an upper end to gear 87 and both second roller 86 and gear 87 are connected to a plate assembly 85 consisting of upper plate 89, lower plate 90 and handle 91. The first roller 78 has a gear 92 attached at an upper end which meshes with gear 87. Each of the rollers 78, 84, 86 and 88 are cantilevered in the sense that they are mounted from one end only (from the top). This makes threading the tape 80 initially much easier. In both FIGS. 11 and 12 the pre-tensioning apparatus 70 is shown in a closed state. Prior to reaching the closed state, a suer having the apparatus in an open state would feed the tape 80 unstretched through the rollers in the manner just described and attach it to the load 18. This is facilitated by lifting shaft 94, by the user grabbing the knob 96, upward and then rotating the top and bottom plate assembly 85 using handle 91 to an open position. After the tape 80 has been attached to the load 18 the upper and lower plate assembly 85 is moved to a position shown in FIGS. 11 and 12 which forces the second roller 86 to be moved around or pivot about the first roller 78 such that it abuts or bears against the tape 80. This puts into effect a sufficient angle of wrap of the tape 80 around roller 78 and 86 to create sufficient friction to pre-stretch the tape 80. The arrangement is now in a position to pre-stretch the tape 80 before it is applied to the load 18. Each of the rollers 78 and 86 have connected at their upper ends gears 87 and 92 which mesh with each other to provide the stretching of the tape 80. The tape 80 is preferably stretched up to 6 times its lineal length. The dimensions of the gears 87, 92 and the corresponding rollers 78, 86 are designed to provide the tape 80 with the desired amount of stretch or elongation as it moves through the rollers when the apparatus 70 is in a closed state.

The apparatus 70 has the advantage of allowing tape 80 to be fed through rollers 78 and 86 to attach an unstretched tape 80 to one side of load 18, and then with a simple locking rotation, provide the required pre-tensioning to tape 80 as it is payed out from the roll 17 of tape 80 as the turntable 4 rotates.

A further embodiment of the invention resides in the ability of the pre-tensioning apparatus 70 to allow tape 80 having an adhesive bonded to one side to be fed through each of the rollers 78, 86 in an unstretched state and attached to a side of the load 18 to be wrapped and also allow the tape 80 to be gripped by the rollers 78, 86 when the tape 80 has been stretched and therefor the load 18 is being wrapped. Specifically, second roller 86 has an exterior surface made from polyethylene and specifically ultra high density molecular weight or UHMW polyethylene that has a series of slits 81 etched into the surface. The slits 81 may be in a cross-hatched pattern or any other suitable pattern which breaks the otherwise smooth and flat surface. The first roller 78 is made from a suitable rubber compound and has a smooth exterior surface. Each of the other rollers 84 and 88 also have an exterior surface made from UHMW polyethylene and has a series of slits 81 etched into the surface or otherwise marked. Guiding roller 82 may also be made from the same material and have slits 81 etched into the surface thereof.

The tape 80 having the other side smooth and non-adhesive abuts against the first roller 78 whereby the rubber compound on the exterior surface of the roller 78 provides an enhanced gripping surface to the tape. The adhesive side of the tape 80 abuts against rollers 84, 86 and 88. The notches or slits 81 in each of these rollers allow enough friction against the adhesive side of the tape 80 in a stretched condition, that is when the load wrapping apparatus is in fact wrapping the load 18 with the tape 80. It also allows little, if any, friction against the tape 80 in an unstretched condition in order to allow an end of the tape 80 to be fed through the rollers and be stuck to a side of the load 18 to be wrapped. As mentioned previously in the past, other solutions used smooth rubber compounds for the rollers and this provided too much friction against the unstretched adhesive tape and the tape tended to be caught and remained stuck to the rollers which created problems with the continuity of applying the tape to the load. The tape tended to be hard to remove or peel off the rubber compounded rollers and eventually the rubber compound wore out and had to be replaced. The present system overcomes this problem by providing the slits or series of notches in the exterior surface of the rollers.

Figure 13:
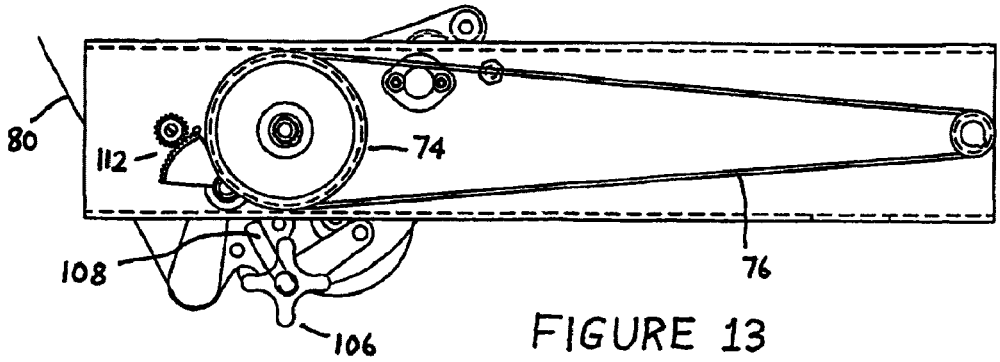
FIG. 13 is a plan view of tension adjustment apparatus.
Figure 14:
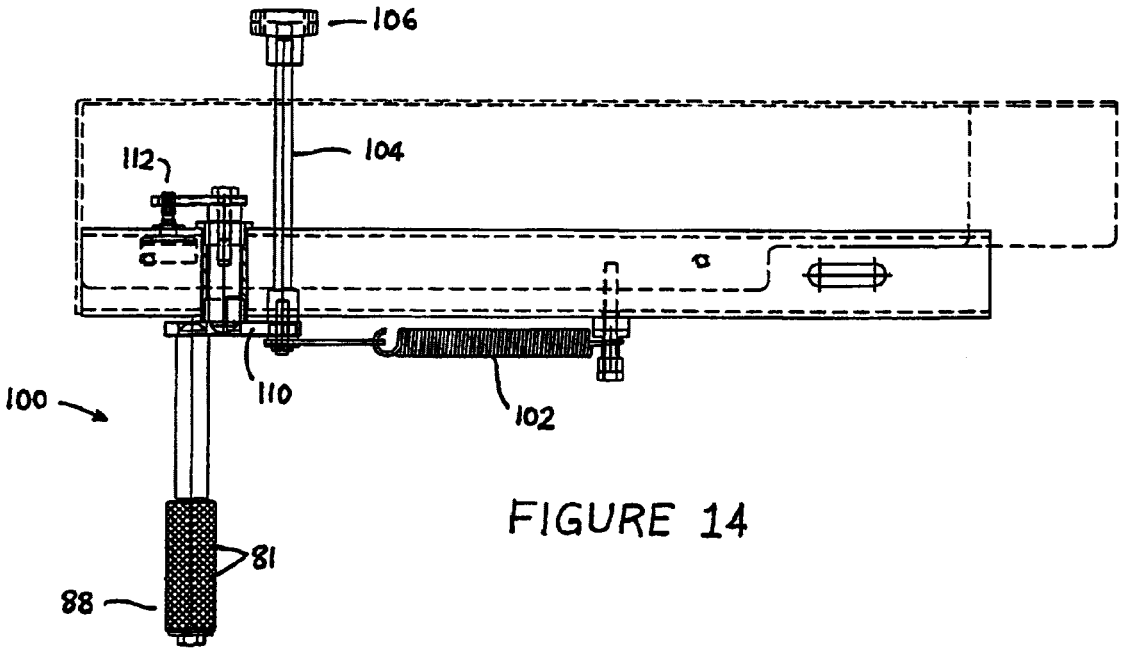
FIG. 14 is a side view of the tension adjustment apparatus shown in FIG. 13.
Figure 15:
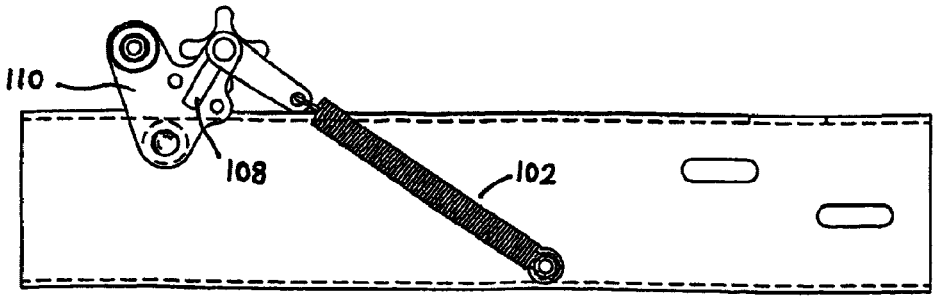
FIG. 15 is an underneath view of the tension adjustment apparatus of FIG. 13 and FIG. 14.

Referring to FIGS. 13 to 15 a tension adjustment assembly 100 is shown which puts a predefined tension or force on the tape 80 as it is applied to the load 18 in dependence upon a resilient means 102 in the form of a spring. Adjustment means in the form of a shaft 104 having a handle 106 is movable within a slot 108 at the bottom of the shaft 104 whereby the position of the shaft 104 within the slot 108 defines a certain tension to be applied to the tape 80. The slot 108 is linked to the resilient means 102 by a bracket 110 and also to the roller 88. With the shaft 104 in the most outward position within the slot 108, tension is greatest on the tape 80 whereas when the shaft 104 is located in the most inward part of the slot 108, the tension on the tape 80 is at its lowest.

This is due to the difference in the moment distance that the tape 80 has to overcome as it leaves the roller 88. The assembly 100 is also linked to a measurement means in the form of a gear mechanism 112 to provide a measure of the angular displacement through which the roller 88 moves due to the tension in the tape 80 as it is being supplied to the load 18. This in turn is sensed or measured by a potentiometer (not shown) which by way of a feedback loop delivers a signal to a variable speed drive 114 (see FIG. 3) which in turn sends a signal to motor 72 to either increase or decrease the rate at which the first roller 78 is to turn or keep it at it present rate. Therefore the speed at which the tape 80 is payed out and applied to the load will be monitored by this feedback loop from the potentiometer through the variable speed drive 114 and back to the motor 72. Where loads are generally square or rectangular in cross-section, and therefore having four edge corners or edge portions, the supply rate of the tape 80 is increased as the tape 80 approaches and contacts each edge corner of the load 18. At the onset of this happening the potentiometer sense the angular displacement and therefore sends a signal to the variable speed drive 114 and to the motor 72 to increase the speed of rotation of the central roller 78 and therefore increase the amount of tape 80 being payed out. As the edge corner passes, the supply rate of the tape 80 decreases and accordingly a further signal is sent to the variable speed drive 114 to the potentiometer and eventually to the motor 72 to decrease the rate at which the central roller 78 is rotating. The same procedure occurs for each of the edge corners of the load.

In this particular embodiment, the pre-tensioning apparatus 70, motor 72 and tension adjustment assembly 100 are linked to carriage assembly 12 for movement up and down the mast 8 in accordance with the computer program.

A force based equilibrium can be achieved, even for loads or irregular shape, whereby the speed of the motor 72 matches the lineal speed of the tape 80 and the tension in the resilient means 102 matches the tension in the payed out tape 80 which is supplied to the load 18.

The following description shall describe the process of the automated stretch wrapping of a pallet load 81 using tape or film. To effectively secure a number of layers of boxes that form the load 18 so that none of the layer of boxes are displaced with respect to each other or any of the boxes within each layer are displaced with respect to each other, it has been necessary to secure the load such that the tape 58 forms a pattern such as a cross hatching pattern along each of the side walls or side faces of the load 18. It has been particularly desirable to have an X-shaped hatching pattern wherein the tape, as it is bound around each of the sides of the load cross each other at particular points to provide the extra strength to secure the load.

This necessitates the stretch wrapping apparatus to move up and down the mast 8 in a sequential manner and in accordance with the speed of rotation of the turntable 4 which rotates the load 18 as it is being wrapped. The exact positioning required for the carriage assembly 6 along the mast 8 and thereby positioning of the tape 58 as it is being dispensed from the sub-assembly unit 20, and therefore the carriage assembly 12, is determined by a pair of sensors. Thus, the location of the carriage assembly 12 is controlled depending on the rotational position of the load 18. One sensor, in the form of a proximity position sensor 60, as seen in FIG. 2, is associated with the toothed wheel 62 and motor 32 with the rotation of the turntable 4. The sensor 60 is mounted adjacent the toothed wheel 62 to sense each tooth of wheel 62 that passes the sensor. Alternatively, it may sense each link of chain 28 passing around sprocket 30 or the number of teeth of sprocket 30. The other sensor is also a proximity position sensor 64 and is mounted adjacent the toothed wheel 66. The sensor 64 senses each tooth of toothed wheel 66 which translates to a particular length of chain 42 and therefore distance moved by carriage assembly 12. Alternatively, the number or links in chain 42 may be sensed by sensor 64 or the number of teeth on drive sprocket 46. The sensors are configured to sense each tooth or each link and send signals to be fed back to a processing means 304 in the form of a microprocessor. A signal is fed back to the microprocessor at the sensing of each tooth or chain link which are counted in counting means of the microprocessor.

Figure 16:
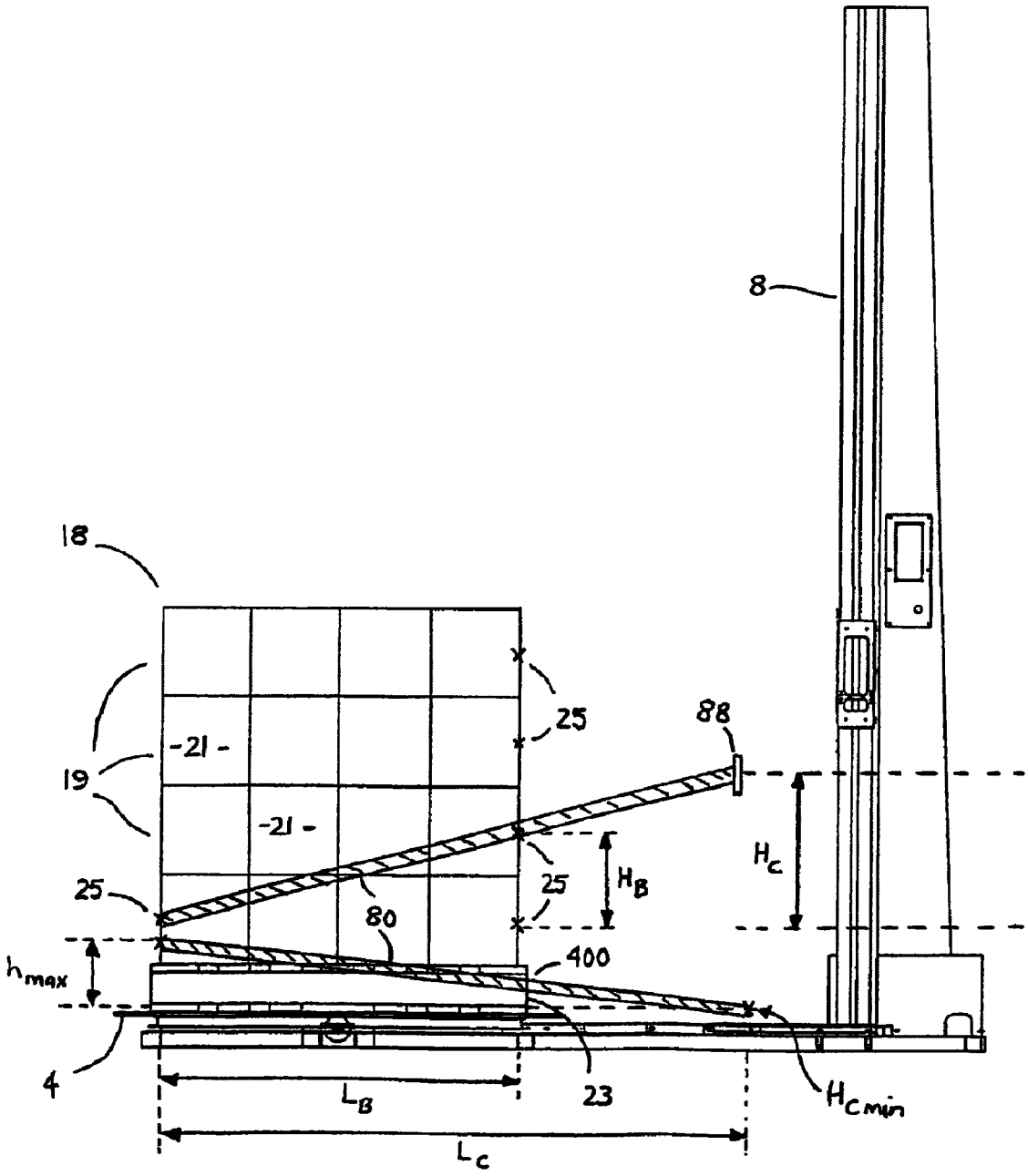
FIG. 16 is a side view of the mast assembly and a load supported on the turntable showing attachment of tape material to the load.

In FIG. 16, there is shown a side view of a load 18 resting on a pallet 23 which in turn is on turntable 4 and a side view of the mast 8 a distance away from the load 18. The load 18 may include a number of layers 19, in this case four layers, of a series of boxes 21 where there are four boxes shown on one side face of each layer 19. There is a minimum height to which the carriage assembly 12 and particularly the pre-tensioning assembly 20 must move so as to make the tape, on its downward descent, reach the pallet 23. The height hmax represents the maximum height the tape must move through on its cycle to cover the lower layer of boxes and the pallet 23. This hmax is programmed into the system. To obtain the cross hatching pattern, the places 25 marked with an X denote points at which the tape will form an X pattern where two portions of tape will overlap each other where adjacent sides of the load meet. Ideally, this is calibrated to be half way along the length of a box 21 so that if there are four layers of boxes there will be four points 25 at the edge corner where the tape will overlap. It is to be noted that the tape need not overlap at an edge corner. This provides a means for calculating a height hmax and a height $H_B$ for the vertical distance that the tape will have to move through to cover one layer of boxes on one side of the load 18. More particularly $H_B$ denotes the height of the box for the ascent or descent of the tape 58 along one side and this translates to a corresponding height $H_c$ through which the carriage will have to be moved along the mast 8. Also shown in FIG. 16 are the constant distances $L_B$ which denotes the length of the pallet or the length of one side of the boxes and $L_c$ which denotes the distance of the carriage unit or from where the tape is dispensed to the left most side of the load 18. It is found proportionally that the ratio of $H_c$ to $H_B$ is equivalent to the ratio of $L_c$ to $L_b$ of which the latter ratio is constant. Therefore a parameter used to control the height through which the carriage assembly must traverse for the corresponding distance $H_b$ is given by:

$$H_C = \left(\frac{L_c}{L_B}\right) H_B$$

The distance $H_c$ is translated into the length of drive chain 42 that passes around sprocket 46 and pulley 50, and therefore the number of links in chain 42, or alternatively is translated to a certain number of teeth of a sprocket (46, 50 or 66) which passes the sensor 64. Therefore, when the requisite number of links of chain 42 is sensed on each cycle, where one cycle equates to the tape 58 traversing one side of the load 18, and a signal is sent back to the microprocessor 304 from the sensor 66 each time a link, or tooth, is sensed. The microprocessor 304 has counting means which counts the number of sensed signals, corresponding to each tooth or link sensed, such that when the counting means reaches a predetermined value, the microprocessor 304 fetches instructions for the next cycle. The predetermined value corresponds to the number of teeth required for a 90° rotation of turntable 4 and the number of links required on chain 42 to move the carriage assembly 12 through distance $H_c$. The microprocessor 304 retrieves its next set of instructions for the next cycle to control the motor 44, as will be described with reference to FIG. 19. Each cycle represents a 90° rotation of the load 18, and as there are 288 teeth on the turntable sprocket 26 this translates to 72 teeth per 90° rotation. Alternatively, the number of teeth on toothed wheel 62 can be sensed by sensor 60 and used to determine a 90° rotation. The sensor 60 may be positioned near sprocket 30 to sense the number of links in chain 28 that need to pass to obtain a corresponding number of teeth on sprocket 26 needed to go through a 90° rotation of the turntable 4.

Figure 17:
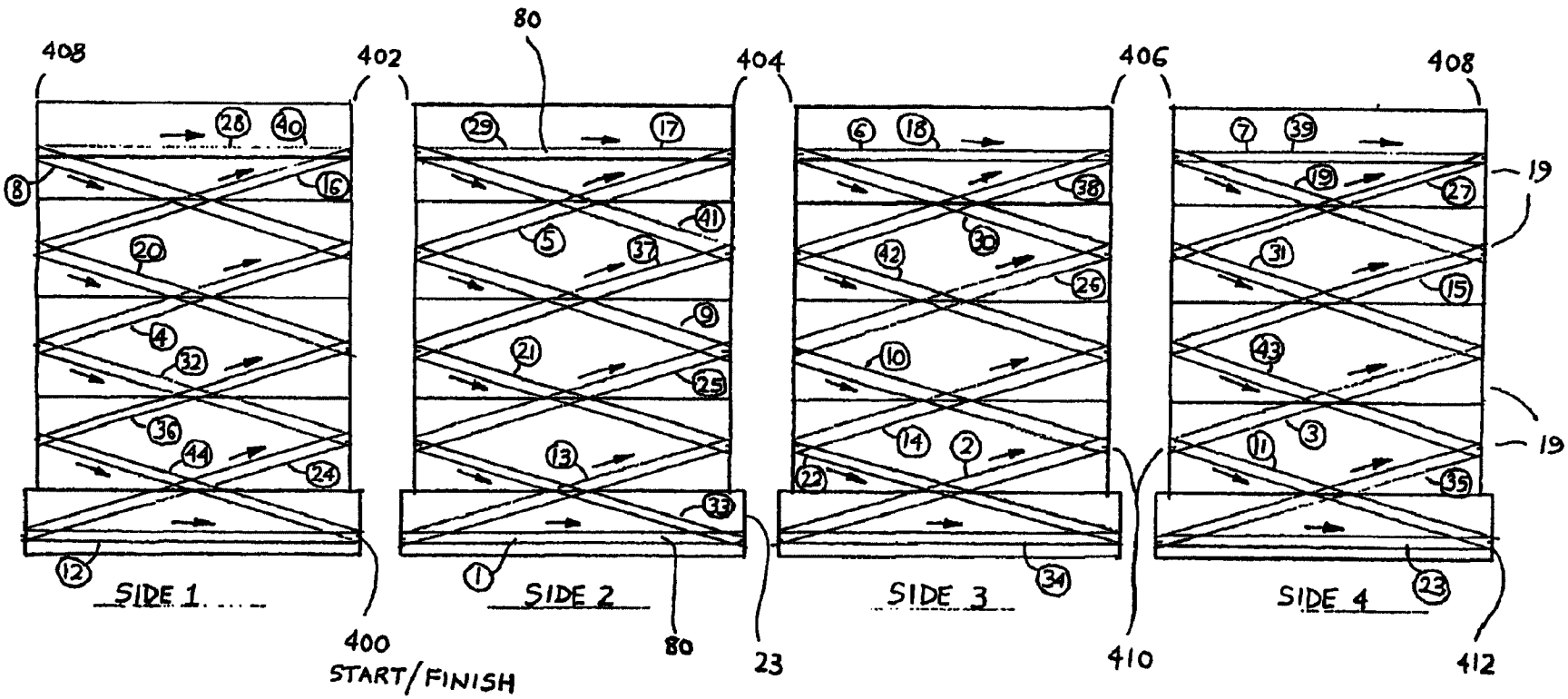
FIG. 17 shows a number of cycles of tape being applied to a load in a pre-defined pattern.

In FIG. 17, there is shown side views of each of the side faces of the pallet load 18. The process of covering the four layers of boxes will now be described. The tape 58 which is output from the sub-assembly 20 is attached to the pallet 23 at the point 400 and this represents a starting point for the wrapping process. The cycles to be described hereinafter are indicated in the Figure by the number in a circle. To start the process the microprocessor 304 receives the instructions stored in a PROM 306, which instructions will be described later on. The initial instructions are transmitted to the motors 32 and 44 and in particular, during the first cycle, motor 32 is turned on to rotate the turntable through 90°. During this rotation, the tape is bound against the side of the pallet 23 on side 2 and goes in a horizontal direction. At the corner edge 404, instructions are received by the motor 32 to continue rotating the turntable at which point sensor 60 has sensed a 90° rotation so that the microprocessor 304 is ready to receive the next set of instructions which direct the motor 44 to be turned on to drive sprocket 46 in an anti-clockwise direction as seen from the left in FIG. 2. Thus, the carriage assembly 12 moves upward the required distance hmax so that during cycle 2 the tape 58 goes in an upward direction along side 3 until it reaches the point 410 at the corner edge 406 ideally at the mid-point of the first layer of boxes. The process continues in an upward direction again during cycles 3, 4 and 5 through distances $H_B$ until the tape reaches the edge corner 404 at the midpoint of the fourth layer of boxes or the upper most layer of the boxes. Obviously during the cycles 3, 4 and 5 the carriage assembly has to traverse an equivalent distance $H_c$ upwardly along the mast 8. During cycles 6 and 7 the motor 44 is shut off to halt the movement of the carriage assembly 12 and as the turntable 4 rotates, the tape horizontally binds sides (banding) 3 and 4 of the upper most layer of the load 18. The during cycles 8, 9,10 and 11, the motor 44 is switched on again and reversed in direction so that the carriage assembly 12 descends the mast 8 until a point 412 is reached. The point 412 is now substantially in the same position as point 400 but rotated through 90°. The process described with respect to cycles 1 through to 11 now repeats for cycles 12 through to 22 and then repeats again for cycles 23 through to 33 and finally for cycles 34 through to 44 after which the original starting point 400 is reached. The cross hatching or 'multi-x' pattern as shown in FIG. 18 is then reached wherein the turntable has rotated 11 times representing 44 90° rotations and the carriage assembly 12 has ascended and descended the mast 8 four times each.

Any particular X pattern configuration can be programmed and stored in the PROM 306. For example, if instead of using a cross hatching patch for four layers only wherein the tape 58 intersects along the corner edges four times, this may be doubled so that they intersect eight times and accordingly the distance $H_B$ is adjusted to b half that for the four layer overlapping configuration of the tape 58.

It is to be noted that aside from using a multi-x pattern a variety of other patterns may be loaded into the computer program in order to wrap a load according to that pattern. For example banding may be a particular pattern required to wrap a load in which horizontal bands are wrapped around the components of the load at various heights or the process of looping in which tape is wrapped over portions of the top of a load. For example if the load is rectangular or square in profile, the tape material traverses each of the corner or other portions linking adjacent sides of the tope of the load. Furthermore the profile of the load need not be rectangular or square but may be a range of shapes which would necessitate a particular pattern to wrap and contain the load with tape material. The parameters may be loaded into the computer program to enable the wrapping of such a pattern.

Figure 18:
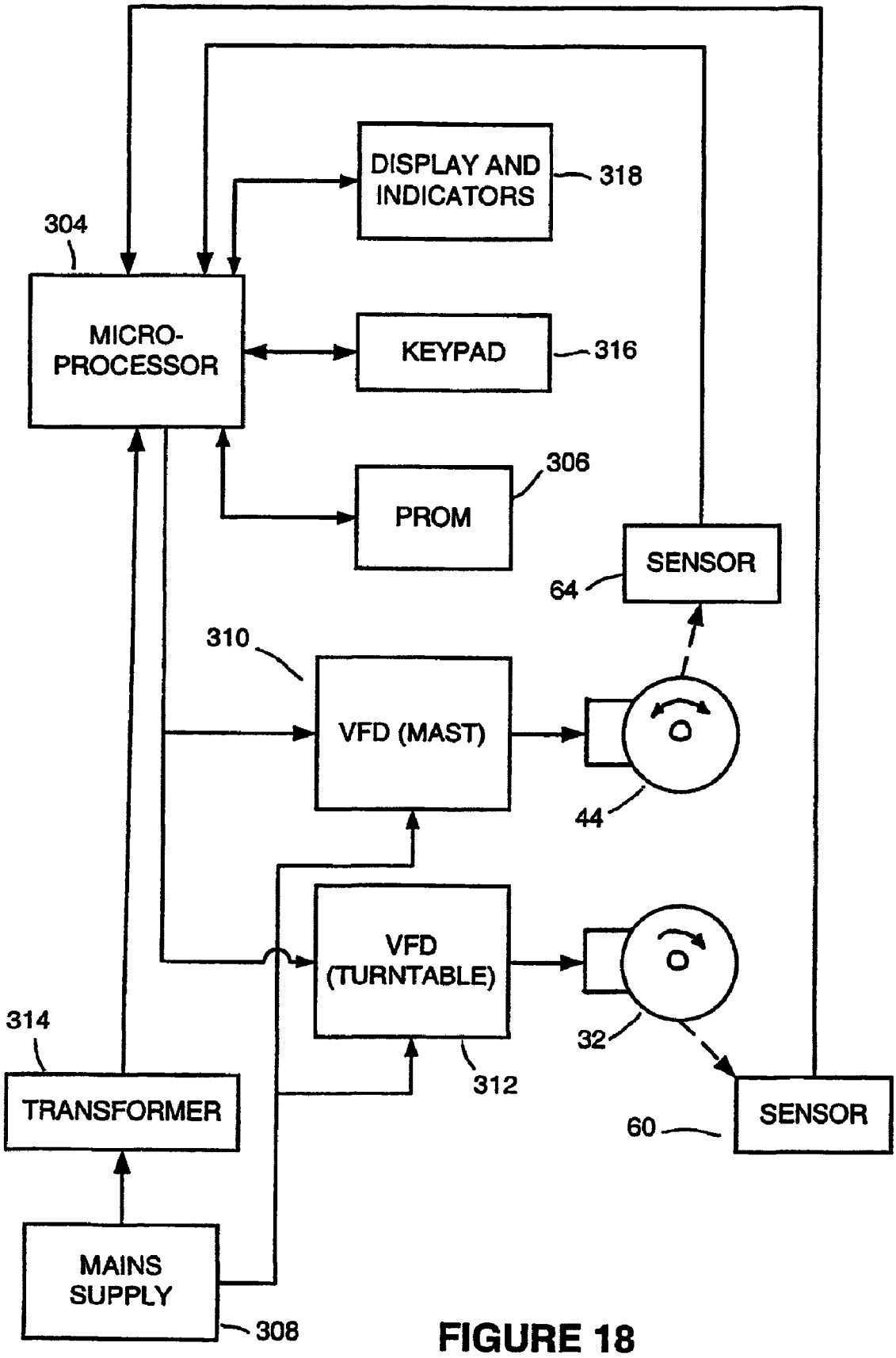
FIG. 18 is a block number of an electronic control system including processing means for controlling the application of tape material to a load.

With reference to FIG. 18, there is shown an automated electronic control system for controlling the wrapping process of the palletised load 18. Power is supplied from a mains supply 308 to each of a variable frequency drive (VFD) 310 for the mast 8 and VFD 312 for the turntable 4. The VFD 310 and 312 are supplied with 240 volts alternating current from the main supply 308. A processing means 304 in the form of a microprocessor is supplied with 12 volts direct current from the mains supply 308 through a transformer 314. Signals are sent from the microprocessor 304 to each of the VFD 310 and 312 in accordance with instructions fetched from PROM 306 storing a computer program and from signals fed back to the microprocessor 304 from sensors 60 and 64. The VFD 310 controls the mast motor 44 while the VFD 312 controls the turntable motor 32. The sensor 60 senses each tooth of toothed wheel 62 and sends a corresponding signal to microprocessor 304 while the sensor 64 senses each tooth of toothed wheel 66 and sends a corresponding signal to microprocessor 304. The number of teeth that have to be sensed to correspond to a 90° rotation of turntable 4, in this case 72 teeth, is pre-stored in microprocessor 304 so that when the counter means of microprocessor 304 reaches 72, a multiple of 72, the microprocessor fetches instruction for the next cycle from the PROM 306. Similarly, the number of links of chain 42 (or teeth on toothed wheel 66) that have to be sensed to move the carriage assembly 12 through distance $H_c$ on mast 8 is also pre-stored in microprocessor 304 so that when the count value of counter means reaches that number of links (or teeth), the microprocessor 304 fetches instructions for the next cycle from PROM 306. It is only when these two conditions are met for each cycle that the process will move on to subsequent cycles. Keypad 316 is used to enter the initial values required by the microprocessor such as the height of the pallet load, the minimum height $H_{cmin}$ of the carriage assembly on the mast, from which the reference level is derived, height hmax, and the number of layers of boxes or the like to be wrapped and therefore the number of heights $H_B$ and $H_c$ that are required. Once these are input into the microprocessor it can calculate $H_B$ and $H_c$ from the overall height of the load and the number of layers required. Display means 318 is used to display each of the values input on the keypad 316. Typically, the keypad 316 and display 318 is accessible through panel 68, shown in FIG. 2, located adjacent the mast 8. Also, located on the panel 68 is a power on/off button and a reset button with the control circuitry located behind the front panel.

The computer program stored in PROM 306 may also have parameters to determine the carriage assembly elevation, speed and position along the mast 8 and also to govern the rotational speed of the turntable 4 in accordance with a particular pattern of tape material 80 being applied to the load 18. Thus an optimal speed of the turntable 4 may be selected and controlled by the computer program and also a corresponding speed of the carriage assembly 12 may be controlled by the computer program so that it reaches its destination on the mast assembly in accordance with the rotation of the turntable 4. For example the carriage assembly 12 may be programmed to reach its next destination within a particular step or procedure of a wrapping process within the next one quarter turntable revolution. All of these variables are loaded into the computer program prior to undertaking the wrapping process. Furthermore, the program may be loaded with other parameters such as the length, width, height of the load to be wrapped together with the number of multi-x patterns to be wrapped or alternatively the number of bands or a combination of both. Furthermore, where a multi-x pattern is used the start height and stop height of the x pattern is loaded into the program together with the number of x's that are to be used in order to cover the load. These parameters may be physically keyed in by an operator. Furthermore, an indication as to whether a heavy or normal duty x-pattern is to be applied, together with banding or looping or any combination of the three patterns and in any sequence may be specified.

The computer program through its processing means 304 may compute the position of the carriage assembly in relation to the rotational position of the turntable 4 as previously described, and also compute the speed of the turntable and the stopping and starting position of the turntable. The processing means 304 may also display on the display means 318 the amount of tape that has been used in any one of the cycles or steps used in the wrapping process and also the cumulative total of the amount of tape used together with a number of cycles or steps completed. All of these originate from the computer program.

Figure 19A:
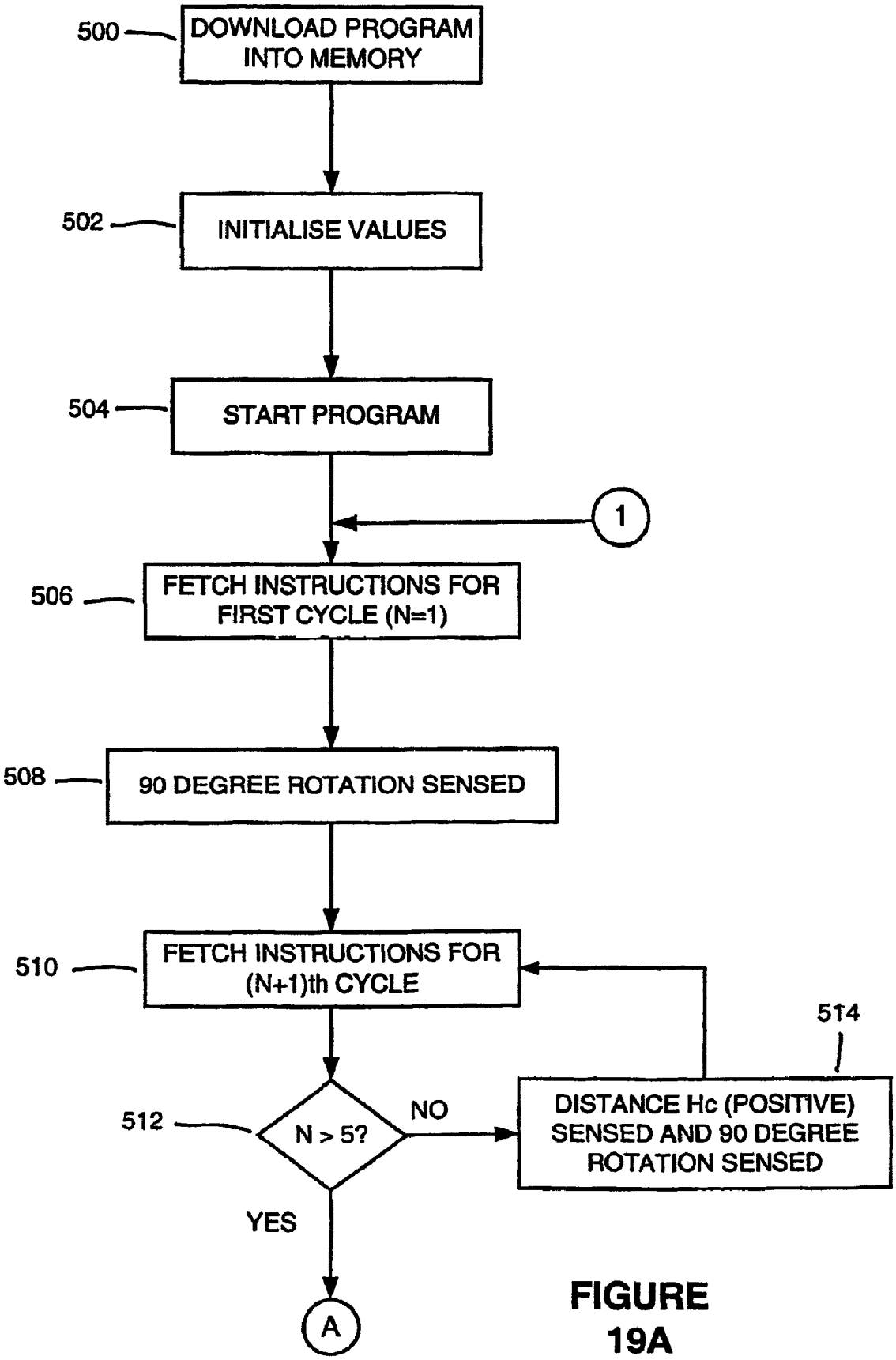
FIGS. 19A and 19B are a flow-chart showing the process involved during a specific load wrapping operation.
Figure 19B:
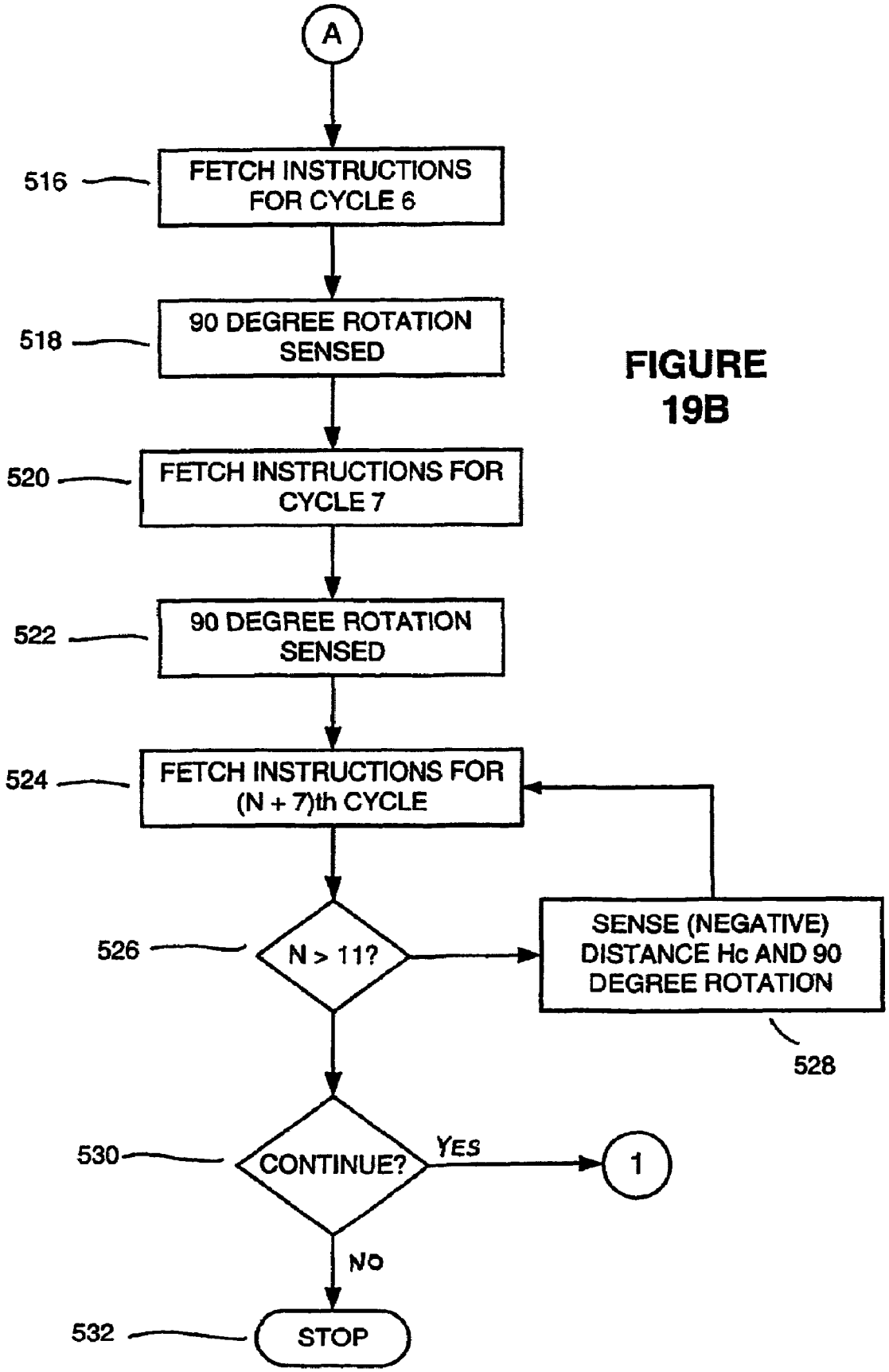
Figure 20:
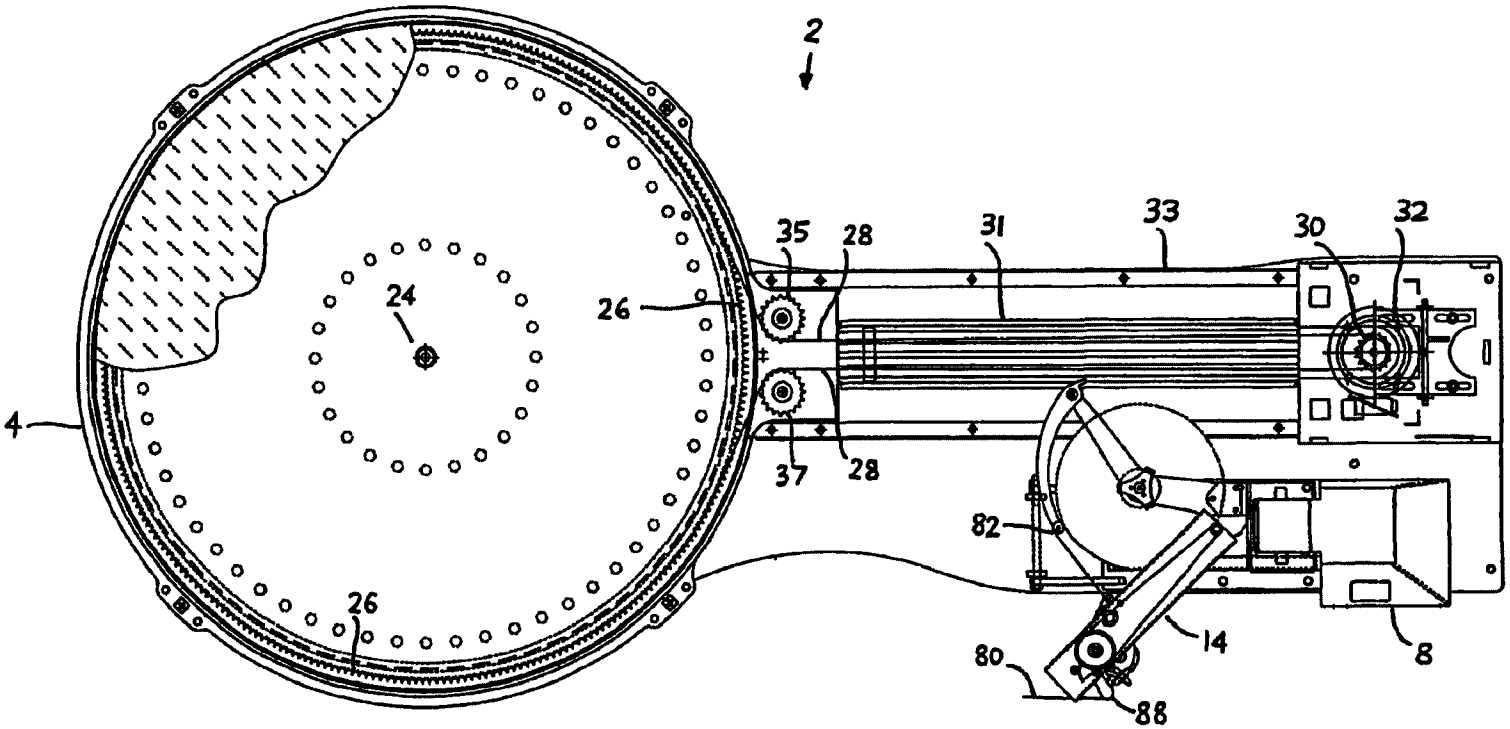
FIG. 20 is a sectional plan view of apparatus for wrapping a load placed on a turntable according to a second embodiment.
Figure 21:
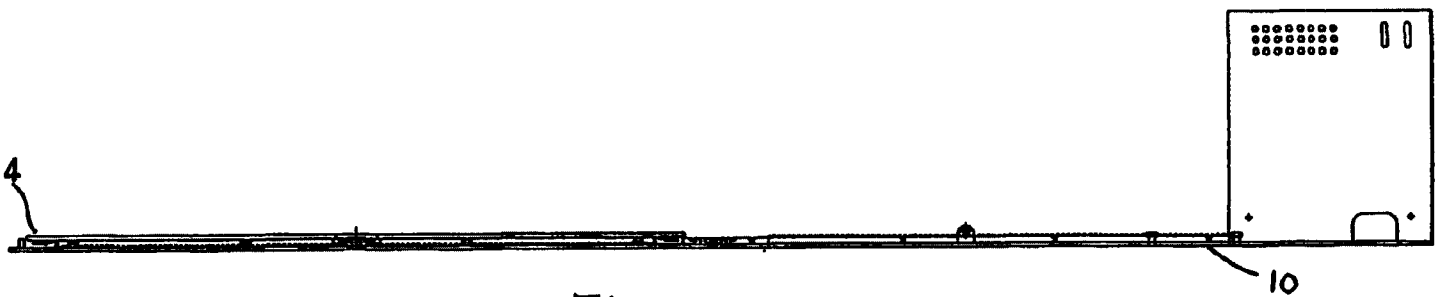
FIG. 21 is a side view of the load wrapping apparatus shown in FIG. 20.
Figure 22:
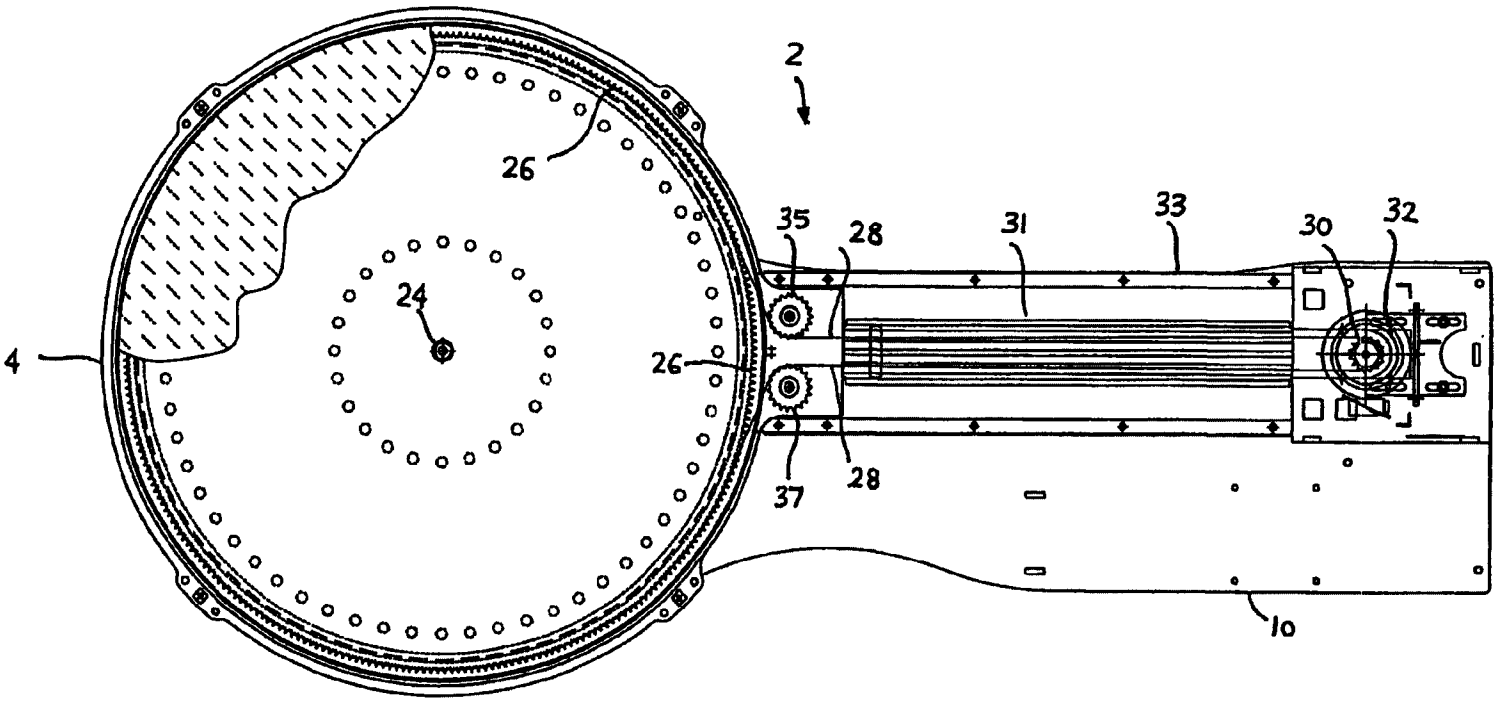
FIG. 22 is a sectional plan view of apparatus similar to FIG. 20 but with the mast assembly removed.
Figure 23:
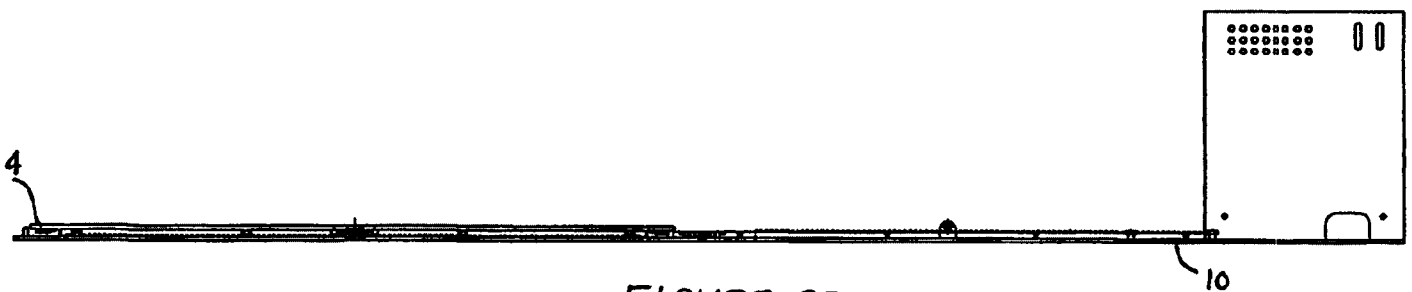
FIG. 23 is a side view of the apparatus shown in FIG. 22.

In FIGS. 19A and 19B, there is shown a flow chart for the processes involved in going through each of the cycles of wrapping the pallet load 18 with reference to FIG. 18. At step 500 the program for each of the cycles is loaded into the memory means 306 which is preferably a PROM. At step 502 the initial values are input to the keypad 316 which in turn is input to the microprocessor 304. The program is then activated at step 504 by pushing the on/off button on panel 68. Then at step 506, the microprocessor 304 will fetch instructions form PROM 306 for the first cycle wherein the VFD 312 will be energised to turn on the motor 32 to drive the turntable sprocket 26 in a clockwise direction. At step 508, once the first 90° rotation of the turntable has occurred the microprocessor will fetch instructions for the second cycle at step 510. On receiving instructions for the second cycle, the microprocessor will energise the VFD 310 to operate motor 44 so that the carriage assembly 12 is stepped through distance hmax in an upward direction along mast 8 and once that distance is reached, and together the second 90° rotation is recorded through step 514, the microprocessor receives the instructions from the memory 306 for the third cycle. This process is repeated for cycles 3, 4 and 5, where the assembly 12 moves a distance $H_c$, until the end of cycle 5 wherein at step 512 the process moves to step 516 where instructions are fetched by the microprocessor for the sixth cycle wherein the power to the VFD 310 is cut off so that there is no movement of the carriage assembly 12 and the tape wraps around the uppermost layer for two sides during cycles 6 and 7. First of all at step 518 and at the end of the sixth cycle the 90° rotation is recorded and then instructions are fetched for the seventh cycle at step 520 and again, once the 90° rotation is recorded at step 522 the instructions for the eighth cycle are fetched at step 524 wherein the VFD 310 is again energised and directs the motor 44 to rotate in the opposite or negative direction and therefore make the carriage assembly 12 descend down the mast 8. Once the further 90° rotation is recorded at the end of the eighth cycle and together with the recording of the negative distance $H_C$, at step 528, instructions are fetched for the ninth, tenth and eleventh cycles which are repeated. Once the end of the eleventh cycle is finished at step 526, the process is either stopped at step 532 or the process returns to step 506 to repeat cycles 1 to 11 for the next stage of wrapping.

It is to be noted that at steps 514 and 528 to achieve the simultaneous recording of the distance $H_C$ that the carriage assembly 12 moves through and a 90° rotation of the turntable, the necessary adjustment is made to the rotational speed of the motors 32 and 44. The particular settings of the motor speeds form part of the program which is downloaded into the memory at step 500.

With reference to FIGS. 20–23, there is shown a further embodiment of apparatus 2 for palletising and wrapping a load. Like reference numerals are shown in FIGS. 20–23 as in FIGS. 1–4. The turntable 4 as mentioned previously is constructed substantially in accordance with the disclosure in Australian Patent No. 615778, to the present applicant, and is configured for rotational movement about a central hub 24. The turntable 4 has a top plate and a bottom plate and located between the top plate and the bottom plate are a series of ball bearings that assist the movement of both plates and also located therebetween is a circular sprocket 26 which has teeth adapted to engage an endless drive chain 28. The drive chain 28 passes around sprocket 26 and also around sprocket 30 which in turn is powered and rotated by a motor 32. The chain 28 passes around the drive sprocket 30 and imparts the rotational movement to the turntable 4 through sprocket 26. A groove to channel 31 passes through a middle portion 33 of base plate 10 housing the drive chain 28 for movement between sprocket 26 and sprocket 30. The middle portion 33 of the base plate 10 is linked to a shoulder located at the edge of turntable 4. Housed within this shoulder are guide sprockets 34 and 37 which provide guiding movement and engagement for the drive chain 28 prior to entry and exit from the sprocket 26 of the turntable 4. A first sensor 60 may be positioned in close proximity to the sprocket 30 in order to sense the number of teeth of the sprocket 30 or the number of links in chain 28 that has passed to provide an indication of the rotational position of turntable 4.

The invention claimed is:

1. An apparatus for binding a three-dimensional load with adhesive tape, wherein the load comprises a plurality of three-dimensional items, each item having an upper end and a lower end that together define the item's height, the apparatus comprising:

a turntable for supporting and rotating the three-dimensional load;

an adhesive tape dispenser for dispensing adhesive tape, the dispenser being movable relative to the turntable and the load;

a logistical controller arranged to control rotation of the load and the movement of the tape dispenser; and means for inputting into the logistical controller at least one dimension corresponding to the height of an item in the load and at least one dimension of the overall load;

the logistical controller comprising a computer program that calculates a preferred tape-placement location on the individual item intermediate its respective upper and lower ends based upon both the inputted dimension corresponding to the height of the item and the at least one dimension of the overall load, wherein the tape-placement location is selected to optimize secure binding of the load; and the controller arranged to control the apparatus to dispense the tape onto the tape-placement location by rotating the load and moving the tape dispenser, and to thereby wrap the load in a load-specific pattern that securely binds the load.

2. The apparatus of claim 1 wherein the turntable comprises a first drive means comprising a sprocket means that imparts rotational movement to the turntable via a first drive chain.

3. The apparatus of claim 1 further comprising a mast assembly and a carriage assembly adapted for vertical sliding movement on said mast assembly, the tape dispenser being mounted on the carriage assembly, wherein the controller is operable to position said carriage along said mast assembly in accordance with a rotational position of said load to locate said tape at said tape placement location.

4. The apparatus of claim 3 wherein the carriage assembly is linked to a second drive chain that is driven by a second sprocket means to enable vertical movement of the carriage assembly.

5. The apparatus of claim 1 wherein the controller is arranged to control the apparatus to dispense the tape at an increased rate as the tape approaches and contacts an edge portion of the load and at a decreased rate after the tape has passed the edge portion.

6. The apparatus of claim 5, comprising variable speed drive means for dispensing the tape.

7. The apparatus of claim 1 wherein the computer program is arranged to compute a maximum height the tape must move during rotation of the turntable to cover a lower layer of items in the load and a pallet supporting the items.

8. The apparatus of claim 1, wherein the computer program is arranged to compute a vertical distance that the tape must move to adhere to the tape-placement location.

9. The apparatus of claim 3 wherein the computer program is arranged to compute a vertical distance through which the carriage must move along the mast so that the tape adheres to the tape-placement location.

10. The apparatus of claim 1 wherein the means for inputting comprises a keypad.

11. The apparatus of claim 3 wherein the controller comprises parameters designating an elevation of the carriage assembly and a speed and position of the carriage assembly along the mast, and the controller is arranged to govern the rotational speed of the turntable based on a particular type of tape material being applied to the load.

12. The apparatus of claim 11 wherein the controller is arranged to select an optimal rotational speed of the turntable based upon a type of tape being deployed.

13. The apparatus of claim 11, wherein the controller is arranged to select an optimal speed of the carriage assembly based upon the rotation of the turntable and a type of tape being deployed.

14. The apparatus of claim 11 wherein the computer program is arranged to compute the position of the carriage assembly in relation to the rotational position of the turntable.

15. The apparatus of claim 11 wherein the computer is arranged to compute the rotational speed of the turntable and the stopping and starting position of the turntable.

16. The apparatus of claim 1 wherein the load-specific pattern comprises a plurality of successive spiral sequences, each spiral sequence comprising a continuous upward spiral and a subsequent downward spiral, giving rise to a pattern whereby the upward spirals are transversely spaced from each other and the downward spirals are transversely spaced from each other and each upward spiral crosses with at least one downward spiral.

17. The apparatus of claim 16 wherein the load is in the form of a rectangular prism and the spirals cross at crossing points, at least some of which are disposed at side edges of the load.

18. The apparatus of claim 16 wherein each spiral sequence includes a continuous upward spiral, followed by a transverse path, followed by a continuous downward spiral and a transverse path.

19. The apparatus of claim 16 wherein each spiral sequence includes a continuous upward spiral, a loop over the top of the load, a continuous downward spiral and a transverse path.

20. The apparatus of claim 16 wherein the load comprises a pallet and the spiral sequence overlaps the pallet.

21. The apparatus of claim 16 wherein the pattern further comprises banding in which horizontal bands are wrapped around the load at predetermined heights.

22. A method of binding a three-dimensional load with adhesive tape, wherein the load comprises a plurality of three-dimensional items, each item having an upper end and a lower end that together define the item's height, the method comprising the steps of:

entering at least one dimension corresponding to a height of an item in the load and at least one dimension of the overall load into a controller that comprises a computer program;

running the computer program to (1) calculate a preferred tape-placement location intermediate the upper and lower end of the item based upon both at the least one inputted dimension corresponding to the height of the item and the at least one dimension of the entire load, wherein the tape-placement location is selected to securely bind the load, and (2) control the apparatus to rotate the load and move an adhesive tape dispenser to adhere tape to the load at the selected tape-placement locations and thereby wrap the load in a load-specific pattern that securely binds the load.

23. The method of claim 22 further comprising the step of running the computer program to control the apparatus to dispense the tape at an increased rate as the tape approaches and contacts an edge portion of the load and at a decreased rate as the tape passes the edge portion.

24. The method of claim 22 comprising the step of running the computer program to calculate the maximum height the tape must move during rotation of the load to cover a lower layer of items and a pallet supporting the items.

25. The method of claim 22 comprising the step of running the computer program to calculate a vertical distance that the tape must move to adhere to the selected tape-placement location.

26. The method of claim 22 comprising the step of running the computer program to calculate a height through which a carriage for dispensing tape must move along a mast supporting the carriage so that the tape adheres to the tape-placement location.

27. The method of claim 22 comprising the step of running the computer program to determine an optimal rotational speed of a turntable supporting the load.

28. The method of claim 26 comprising the step of running the computer program to determine an optimal speed of the carriage assembly.

29. The method of claim 22 further comprising the step of dispensing tape from a tape dispenser which is movable up and down relative to the load, in a plurality of successive spiral sequences, each spiral sequence comprising a continuously upward spiral and a subsequent downward spiral giving rise to a pattern whereby the upward spirals are transversely spaced from each other and the downward spirals are transversely spaced from each other and each upward spiral crosses with at least one downward spiral.

30. The method of claim 29 whereby the spirals are determined according to the particular composition of items in the load such that the tape is located on the load at positions according to the particular composition of items in the load.

31. The method of claim 29 wherein the load is in the form of a rectangular prism and the spirals cross at crossing points, at least some of which are disposed at the side edges of the load.

32. The method of claim 29 wherein each spiral sequence includes a continuous upward spiral followed by a transverse path followed by a continuous downward spiral and a transverse path.

33. The method of claim 29 wherein each spiral sequence includes a continuous upward spiral, a loop over the top of the load, a continuous downward spiral and a transverse path.

34. The method of claim 33 wherein the load includes a pallet and the spiral sequence overlaps with the pallet.

35. The method of claim 29 wherein the pattern further comprises banding in which horizontal bands are wrapped around the load at predetermined heights.

36. The method of claim 22 wherein the tape is of the type which is stretchable and is provided with adhesive on one side only.

37. The method of claim 36 wherein the tape is of the type which is stretchable and which is detackifiable upon stretching.

* * * * *